US009429039B2

(12) United States Patent
Finlayson

(10) Patent No.: US 9,429,039 B2
(45) Date of Patent: Aug. 30, 2016

(54) CASING

(71) Applicant: ROLLS-ROYCE PLC, London (GB)

(72) Inventor: James Alex Finlayson, Ashby-de-la-Zouch (GB)

(73) Assignee: ROLLS-ROYCE plc, London (GB)

( * ) Notice: Subject to any disclaimer, the term of this patent is extended or adjusted under 35 U.S.C. 154(b) by 577 days.

(21) Appl. No.: 13/872,594

(22) Filed: Apr. 29, 2013

(65) Prior Publication Data

US 2013/0302154 A1 Nov. 14, 2013

(30) Foreign Application Priority Data

May 11, 2012 (GB) ..... 1208243.4

(51) Int. Cl.
*F01B 25/16* (2006.01)
*F01D 25/24* (2006.01)
*F01D 21/04* (2006.01)

(52) U.S. Cl.
CPC ..... *F01D 25/24* (2013.01); *F01D 21/045* (2013.01); *F05D 2300/171* (2013.01); *F05D 2300/173* (2013.01); *F05D 2300/21* (2013.01); *F05D 2300/603* (2013.01)

(58) Field of Classification Search
CPC ..... F01D 21/045; F01D 25/24; F05D 2300/121; F05D 2300/171; F05D 2300/173; F05D 2300/603
USPC ..... 415/9
See application file for complete search history.

(56) References Cited

U.S. PATENT DOCUMENTS 5,163,809 A 11/1992 Akgun et al.
5,447,411 A 9/1995 Curley et al.
5,486,086 A * 1/1996 Bellia ..... F01D 21/045 415/9
6,113,347 A * 9/2000 Forrester ..... F01D 21/045 415/173.4
6,206,631 B1 3/2001 Schilling
6,637,186 B1 10/2003 Van Duyn
9,140,135 B2 * 9/2015 Robertson, Jr. ..... F01D 21/045
2004/0141837 A1 7/2004 McMillan et al.
2005/0074328 A1 * 4/2005 Martindale ..... F01D 21/045 415/173.1
2006/0165519 A1 * 7/2006 McMillan ..... F01D 21/045 415/173.1
2008/0199301 A1 8/2008 Cardarella, Jr
2009/0214327 A1 * 8/2009 Evans ..... F01D 21/045 415/9
2011/0217156 A1 * 9/2011 McMillan ..... F01D 21/045 415/9
2013/0202424 A1 * 8/2013 Lussier ..... F01D 5/08 415/200

FOREIGN PATENT DOCUMENTS

GB 2 115 487 A 9/1983
GB 2 365 926 A 2/2002

OTHER PUBLICATIONS

Aug. 14, 2012 Search Report issued in British Application No. GB1208243.4.

* cited by examiner

*Primary Examiner* — Eric Keasel
*Assistant Examiner* — Jason Mikus
(74) *Attorney, Agent, or Firm* — Oliff PLC

(57) ABSTRACT

A containment case for a gas turbine including: a cylindrical outer casing extending about an axis and having a radially outer and a radially inner surface; a coaxially arranged cylindrical inner skin formed of a harder material than the outer casing joined to the inner surface of the cylindrical outer casing; and an array of ribs extending radially from the inner skin towards the axis. The case for can have the coaxially arranged cylindrical inner skin formed of a harder material than the outer casing joined to the inner surface of the cylindrical outer casing by a galvanic isolation layer.

16 Claims, 3 Drawing Sheets

CASING

TECHNICAL FIELD OF INVENTION

The present invention relates to turbine engines and in particular cases surrounding rotatable or rotating parts and particularly containment cases for a fan of a gas turbine.

BACKGROUND OF INVENTION

Rotating components in a gas turbine engine can, in rare situations, become released from their mounts. Containment systems are provided in a gas turbine engine to capture these released components and dissipate a significant proportion of the energy of the component.

The fan cases in particular, owing to the length of the fan blades, is one of the largest components on the engine—the fan case of the Trent XWB has a diameter of around 3 meters. Because of its size the fan case is often one of the heaviest components of the engine.

Fan cases have, in the past, had a rigid outer skin within which a low density liner is positioned and which can crush during impact of a released blade to absorb some of the energy. The outer skin is typically of a similar or higher hardness than that of the released blade which prevents the blade passing through the casing.

Unfortunately, the use of materials similar to that of the blades is expensive due to the price of the material. Other materials which offer the same or greater hardness are typically much heavier and the significant use of these would increase the weight of the engine to an unacceptable level.

Material with less weight is typically softer than the material of the blade. The use of this material for the containment case increases the risk of blade fragments passing through the casing to an unacceptable level.

One solution that has been proposed in the related art is that described in US2008/0199301 where the casing is of a two part construction with a containment ring of first material mounted with an interference fit within a casing of a lighter and softer material e.g. aluminium.

It is an object of the present invention to seek to provide an improved casing for a gas turbine.

STATEMENTS OF INVENTION

According to a first aspect of the invention there is provided a containment case for a gas turbine comprising: a cylindrical outer casing extending about an axis and having a radially outer and a radially inner surface; a coaxially arranged cylindrical inner skin formed of a harder material than the outer casing joined to the inner surface of the cylindrical outer casing; and an array of ribs extending radially from the inner skin towards the axis. Advantageously, the ribs provide stiffness to the skin and assist in the break-up of a released blade on the skin.

Preferably the outer casing is selected from a group comprising aluminium or a composite formed from a plurality of plies of fibres in a resin matrix.

The skin may be formed from steel or a steel alloy or another material harder than that of the outer casing.

Preferably the skin is provided by a plurality of skin sections arranged as a circumferential array. Each skin section may overlap at its axially extending edge with an adjacent skin section. Advantageously, the use of multiple skin sections allows each section to be formed separately and tested before assembling within the outer casing. The overlap can be arranged in a direction which inhibits and prevents a released blade from escaping between the adjacent skins.

Preferably the casing further comprises an acoustic liner positioned on the radially inner surface of the skin. The acoustic liner may have a honeycomb core filled with a low-density epoxy filler. The acoustic liner reduces the noise emanating from the engine and can provide a smooth airwashed surface to the associated blade tips.

Preferably the array of ribs is provided by a plurality of ribs with a circumferential spacing between each rib which is a function of the blade tip chord. Preferably the ratio of the spacing to the tip chord is less than 1 and more preferably less than 0.5 and even more preferably between 0.2 and 0.3. Each rib may be angled to the direction in which the casing axis extends. The ribs may lean towards a tangent to the casing.

Each rib may have a wavy profile in a section taken through the ribs. Such an arrangement further improves the stiffness of the rib and the skin. The stiffness of the skin may be further increased by the provision of dimples thereto.

Each rib may have a hollow cavity open to the radially outer surface of the skin. The arrangement is advantageous as impact to the rib causes spreading of the load and reduces the possibility of the rib being pushed through the outer casing.

Preferably the skin and outer casing are joined by a layer of polymer or elastomer which may be selected from the group comprising polyurethane and thermoplastic elastomers. Advantageously, the layer may provide galvanic isolation between material of skin and material of casing.

According to a second aspect of the invention there is provided a gas turbine engine having a containment casing according to any of the preceding ten paragraphs wherein the array of ribs is associated with a row of rotatable aerofoils, each aerofoil having a tip with a tip chord length between a leading edge of the blade and a trailing edge of the blade; wherein the ribs spaced from each other in a circumferential direction at a distance that is up to a ¼ of the tip chord length.

The tip has a stagger angle and the ribs may be angled to the direction in which the casing axis extends at 90 degrees to the tip stagger angle.

The rotatable aerofoils may be fan blades.

DETAILED DESCRIPTION OF INVENTION

Figure 1:
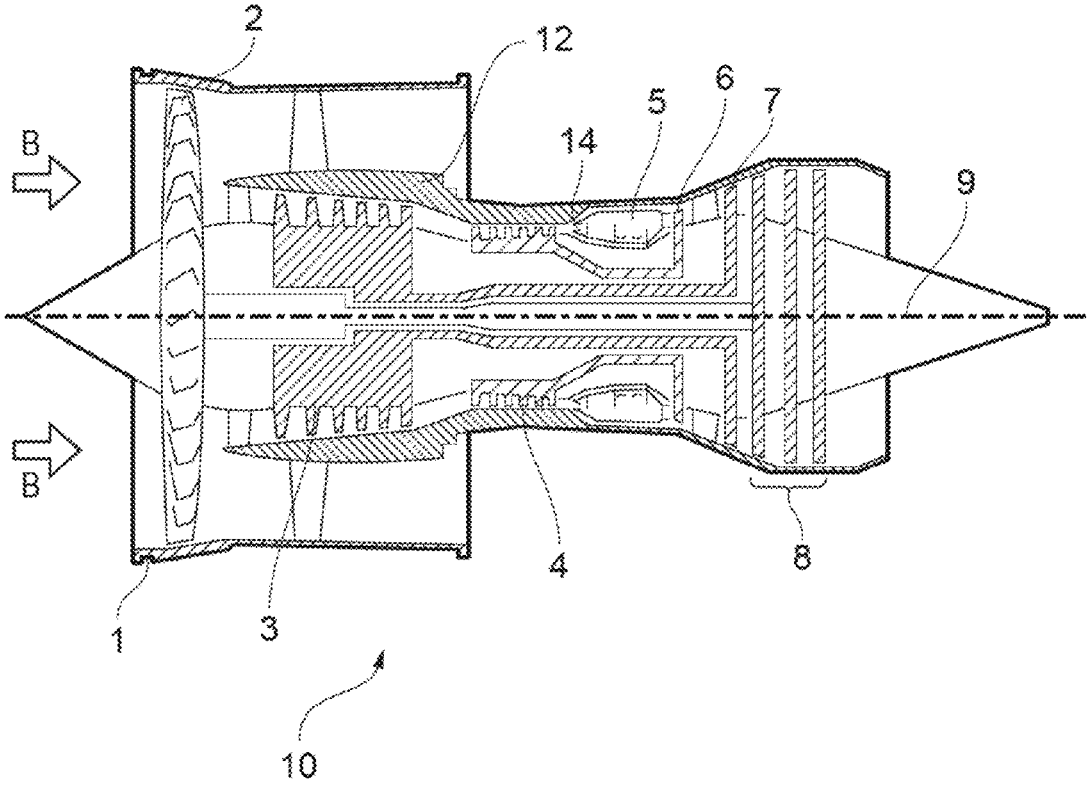
FIG. 1 depicts a cross section of a gas turbine.

With reference to FIG. 1, a ducted fan gas turbine engine generally indicated at 10 comprises, in axial flow series, a fan casing 1, a propulsive fan 2, an intermediate pressure compressor 3, a high pressure compressor 4, combustion equipment 5, a high pressure turbine 6, an intermediate pressure turbine 7, a low pressure turbine 8 and an exhaust nozzle 9.

Air entering the fan casing 1 is accelerated by the fan 2 to produce two air flows, a first air flow into the intermediate pressure compressor 3 and a second air flow that passes over the outer surface of the engine casing 12 and which provides propulsive thrust. The intermediate pressure compressor 3 compresses the air flow directed into it before delivering the air to the high pressure compressor 4 where further compression takes place.

Compressed air exhausted from the high pressure compressor 4 is directed into the combustion equipment 5, where it is mixed with fuel that is injected from a fuel injector 14 and the mixture combusted. The resultant hot combustion products expand through and thereby drive the high 6, intermediate 7 and low pressure 8 turbines before being exhausted through the nozzle 9 to provide additional propulsive thrust. The high, intermediate and low pressure turbines respectively drive the high and intermediate pressure compressors and the fan by suitable interconnecting shafts.

Figure 2:
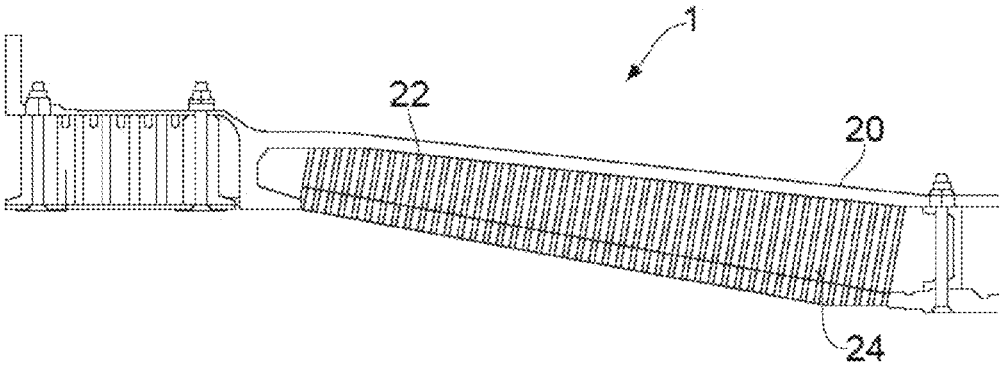
FIG. 2 depicts a cross section through a portion of a fan casing.

FIG. 2 depicts a section of the fan casing in more detail and shows the fan casing 1 which is made up of an outer casing 20 with a thin skin 22 of a harder material. Within the inner skin is an acoustic liner 24 that is provided by an aluminium honeycomb core filled with a low-density epoxy filler. The acoustic liner provides a first layer of energy absorption for a released blade but also damps noise. Other known forms of acoustic liner may be used. The inner surface of the acoustic liner may be provided with a septum layer which is sufficiently robust to inhibit damage to the acoustic liner from ice shedding from the aerofoil but is not so robust that a blade is prevented from passing through it.

The outer casing 20 is preferably formed from a lightweight material such as aluminium, aluminium alloy or a composite which is made up from repeated layers of carbon or glass fibres embedded in a suitable resin, e.g epoxy.

The thin skin 22 is preferably steel and may be a precipitation hardened stainless alloy to reduce the likelihood of corrosion. A skin thickness of between 1 mm and 2 mm has been found to be acceptable for most applications.

So as to prevent galvanic corrosion between the skin 22 and the casing 20 a coating (30, FIG. 3) such as polyurethane or a suitable elastomer is applied to the skin so as provide appropriate galvanic insulation. Preferably the polyurethane or elastomer can be cured following location of the skin and the casing so as to bond the components together. The coating can also be provided to fully encase the skin so as to prevent galvanic corrosion between the skin and the casing as well as between the sin and the acoustic liner. The thickness of the coating between the skin and the casing is of sufficient thickness, typically greater than 0.5 mm, to allow differential thermal expansion across the joint over the expected temperature range.

One of the advantages of using a galvanic insulation layer 30 such as polyurethane is that it is significantly more flexible than the material of both the skin and the casing. The flexibility inhibits the transmission of any generated shear force between the skin and casing.

Although the steel skin may be manufactured as a cylinder it is desirable to provide it as a plurality of sheet sections with a lap joint between adjacent sheets. Because a detached blade has a circumferential component it is desirable that the radially inner portion of the lap joint is ahead of the radially outer portion of the lap joint in the direction of the circumferential component as such an arrangement prevents a release blade from travelling under the skin. The size of the lap joint is such that differential thermal expansion over the expected temperature range can be accommodated.

In one embodiment there are two sheets sections with each sheet section providing 180 degrees of the skin circumference. In alternative embodiments 3, 4, 6 or 8 sheet sections are provided with each sheet section providing 120 degrees, 90 degrees, 60 degrees or 45 degrees of the skin circumference as appropriate.

The skin may be further stiffened to provide greater protection under impact through the provision of at least one rib. Preferably two or more parallel ribs are provided at an appropriate spacing that can be around quarter of the blade tip true chord. Such a spacing is beneficial as it permits the blade leading edge to engage the ribs and assist in the fracture of the blade on the hard skin. As depicted in FIG. 3, the ribs are arranged in a circumferentially extending array with each rib bounded at its radially outer end by the casing skin.

Each rib has a radial component that is preferably along the true radius from the engine axis but could lean towards the direction of blade rotation i.e. towards a tangent to provide further fracture assistance.

Each rib is also inclined relative to the engine axis and preferably at angle that is orthogonal to the tip stagger angle of the fan blade 2. This has been found to be particularly beneficial for catching the blade leading edge in the ribs.

In an alternative embodiment the ribs are at an angle which facilitates their deflection upon impact of the blade. The deflection may cause a domino effect of deflections along the array of ribs as the blade moves in the circumferential direction. The deflections may also result in a crushing effect to the ribs. Each deflection or crushing movement absorbs energy from the blade and reduces the risk of any possibility of unwanted escape of material from the engine.

In a further alternative embodiment each rib has a wavy profile to further improve the stiffness of the skin.

Figure 3A:
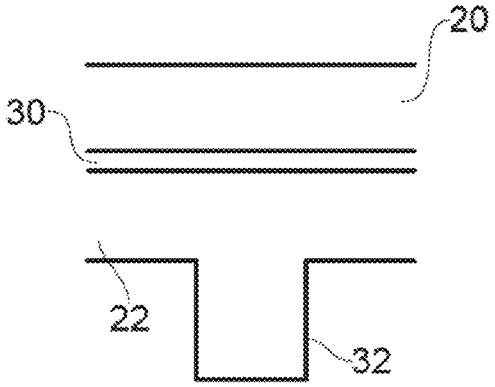
FIGS. 3*a* and 3*b* show alternatives for ribs provided by a skin of a casing
Figure 3B:
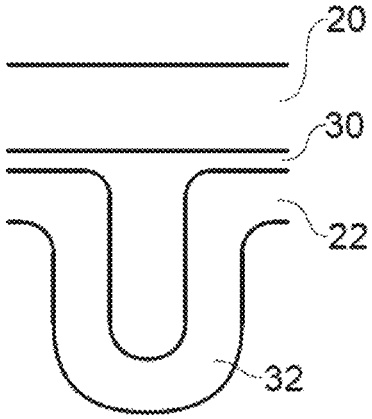

Each rib 32 may be of the solid type as shown in FIG. 3*a* or, more preferably, of a hollow type as shown in FIG. 3*b* that is provided by a fold of the skin 22. Each fold may be formed from a stamping of the skin which, by impact from the reverse side, causes an elongate depression within the localised region of the passing fan. Alternatively, the folds may extend across the whole of the skin section but it will be appreciated that adds additional material which increases the weight of the component. One of the advantages of the hollow type of rib is that the force of any impact to it from the blade is pushed sideways and further absorbed which reduces the possibility of the blade being pushed through the casing skin.

In an alternative manufacturing method the skin or skin section is passed through a set of hot or cold rollers set at an angle to roll the hollow rib features. Alternatively the ring rolling roller can be set with features in its surface such that the ribs are formed during the ring rolling process—this will also work where the skin is haded.

If the skin is designed to fit a con-di casing a preferred method is to make the skin by a fabrication type method. This can be arranged such that the rib also becomes the point where the plates overlap and features in the rib are then used to lock together the skin sections. Some freedom of movement is required in this joint as it is may be difficult to get the last interlocking joint to mate correctly. When assembled an even pressure is applied on the inside, for instance using a hydraulic bag arrangement to ensure good contact between the liner plates and the PU whilst the PU is then cured. Using an induction heater to heat the liner plates the temperature can be controlled by measuring the resistance change of the plates and the PU cured to adhere to the case and the liner plates. This method will also work for a parallel liner.

Alternative methods of manufacture could include additive manufacturing methods where selective layers are built up using powder bed or wire fed technologies.

To improve hoop strength of the arrangement, the fore and aft edges can be rolled to turn over the edge to create a mini flange. Alternatively small weld at the overlaps can ensure a hoop continuous structure even if the abradable and acoustic liners were to collapse.

Figure 4:
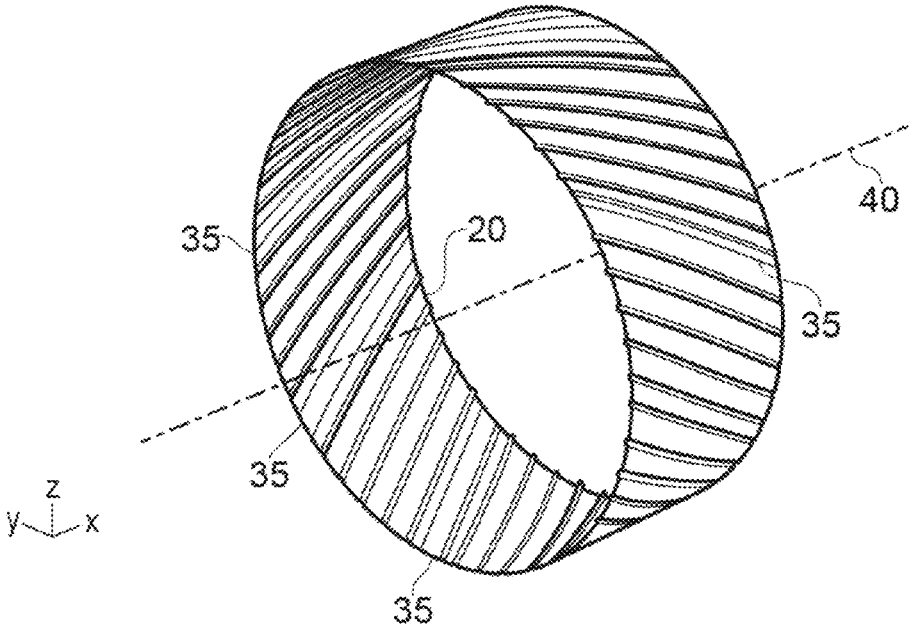
FIG. 4 shows a perspective of one embodiment of skin in accordance with the invention.

FIG. 4 depicts a skin manufactured from a plurality of skin segments. The skin itself may be located in a suitably formed channel within the outer casing 20 such that the skin radially inside diameter is flush with the radially inside diameter of the outer casing either side of the skin. Such an arrangement may assist assembly. Each of the lap joints 35 is at an angle that is parallel to the angle of the ribs to avoid the necessity of the lap joint cutting across one or more of the ribs. The relationship between the ribs and angled lap joint helps to prevent unwanted axial movement along the axis 40 of the skin, outer casing and casing.

The skin 22 or casing 20 may be provided with dimples that increase the stiffness of the component. Preferably the dimples are positioned away from the ribs.

It will be appreciated that the provision of a harder skin to a more lightweight casing material mitigates against potential puncture problems inherent when the lightweight material contains a blade formed of harder material. The use of a galvanic corrosion layer between the skin and the casing not only solves the problem of galvanic corrosion between the skin and the material of the casing, which may be a composite, but also addresses the problem of differential thermal expansion which may occur between the different materials. The use of a plurality of skin sections improves the ability to manufacture the casing with lap joints providing further capability to absorb differential expansion.

The use of a polyurethane, epoxy or other suitable polymer with adhesive properties as the galvanic corrosion layer further offers advantages in the joining of the skin to the outer case. The skin can become a replaceable item which is replaceable in addition to, or separately from, the acoustic liners between the skin and the fan. Beneficially, the skin provides further protection to the casing which becomes less likely to be damaged during replacement of the liners which may become damaged in normal use from the impact of ice or other foreign objects.

The ribs provide benefits in that both the stiffness of the skin and the ability to better break up a released blade is improved as well as limiting the axial extent of the blade and casing interaction.

Where different embodiments are shown or described it will be appreciated that where appropriate features may be interchangeably moved between embodiments.

The invention claimed is:

1. A containment case for a gas turbine, the case comprising:

a cylindrical outer casing extending about an axis and having a radially outer surface and a radially inner surface;

a coaxially arranged cylindrical inner skin formed of a harder material than the outer casing joined to the inner surface of the cylindrical outer casing; and an array of ribs extending radially from the inner skin towards the axis, wherein each rib has a hollow cavity open to a radially outer surface of the inner skin.

2. A gas turbine engine comprising:

a containment case comprising:

a cylindrical outer casing extending about an axis and having a radially outer surface and a radially inner surface;

a coaxially arranged cylindrical inner skin formed of a harder material than the outer casing joined to the inner surface of the cylindrical outer casing; and an array of ribs extending radially from the inner skin towards the axis, wherein:

the array of ribs is associated with a row of rotatable aerofoils, each aerofoil having a tip with a tip chord length between a leading edge of the aerofoil and a trailing edge of the aerofoil, and the ribs are spaced from each other in a circumferential direction at a distance that is up to a ¼ of the tip chord length.

3. A gas turbine engine according to claim 2, wherein the tip has a stagger angle and the ribs are angled to the direction in which the casing axis extends at 90 degrees to the tip stagger angle.

4. A gas turbine engine according to claim 2, wherein the rotatable aerofoils are fan blades.

5. A containment case according to claim 1, wherein the outer casing is aluminium or a composite formed from a plurality of plies of fibres in a resin matrix.

6. A containment case according to claim 1, wherein the inner skin is formed from steel or a steel alloy.

7. A containment case according to claim 1, wherein the inner skin is provided by a plurality of skin sections arranged as a circumferential array.

8. A containment case according to claim 1, wherein the inner skin has dimples for providing stiffness to the inner skin.

9. A containment case according to claim 1, wherein the inner skin and the outer casing are joined by a layer of polymer or elastomer.

10. A containment case according to claim 2, wherein each rib is angled to the direction in which the casing axis extends.

11. A containment case according to claim 10, wherein each rib leans towards a tangent.

12. A containment case according to claim 10, wherein each rib has a wavy profile in a section taken through the array of ribs.

13. A containment case according to claim 10, wherein the inner skin has dimples for providing stiffness to the inner skin.

14. A containment case according to claim 7, wherein each skin section overlaps at its axially extending edge with an adjacent skin section.

15. A containment case according to claim 9, wherein the polymer or elastomer is selected from a group comprising polyurethane and thermoplastic elastomers.

16. A containment case according to claim 9, wherein the layer provides galvanic isolation between the material of the inner skin and the material of the outer casing.

* * * * *